US011304472B2

(12) United States Patent
Ji

(10) Patent No.: US 11,304,472 B2
(45) Date of Patent: Apr. 19, 2022

(54) HELMET-SPECIFIC INNER CAP

(71) Applicant: Jack Ji, Rugao (CN)

(72) Inventor: Jack Ji, Rugao (CN)

( * ) Notice: Subject to any disclaimer, the term of this patent is extended or adjusted under 35 U.S.C. 154(b) by 729 days.

(21) Appl. No.: 15/828,646

(22) Filed: Dec. 1, 2017

(65) Prior Publication Data

US 2019/0014853 A1 Jan. 17, 2019

(30) Foreign Application Priority Data

Jul. 14, 2017 (CN) ..... 201710574650.0

(51) Int. Cl.
*A42C 5/04* (2006.01)
*A42B 3/10* (2006.01)
*A42B 1/008* (2021.01)

(52) U.S. Cl.
CPC ..... *A42C 5/04* (2013.01); *A42B 1/008* (2013.01); *A42B 3/10* (2013.01)

(58) Field of Classification Search
CPC ..... A42C 5/04; A42B 1/008; A42B 3/10
See application file for complete search history.

(56) References Cited

U.S. PATENT DOCUMENTS 2,718,584 A * 9/1955 Hariu ..... A42B 1/008 219/535
3,366,971 A * 2/1968 Scherz ..... A42B 3/10 2/412
4,610,247 A * 9/1986 Stroup ..... A42B 1/046 128/201.22
4,768,235 A * 9/1988 Webster ..... A41D 13/11 128/201.26
H823 H * 10/1990 Conkle ..... 2/205
5,038,047 A * 8/1991 Still ..... A61B 6/107 128/857
5,251,336 A * 10/1993 Nevins ..... A42B 1/046 2/173

(Continued)

FOREIGN PATENT DOCUMENTS

DE 20001151 U1 * 7/2000 ..... A41D 13/1153
JP 3210690 U * 6/2017 ..... A42B 1/046
WO WO-2017085273 A1 * 5/2017 ..... A42B 1/008

*Primary Examiner* — Tajash D Patel
(74) *Attorney, Agent, or Firm* — Hovey Williams LLP

(57) ABSTRACT

The use of select knitting processes allow the production of a cap liner with a separate eye opening and several distinct mesh structures that are individually designed to enhance the comfort of the eyes, nose, and mouth of the wearer. Generally, the cap liner comprises: (a) a cap body comprising an upper mesh structure; (b) a neck retainer that is integrally formed with the cap body; (c) an eye opening positioned in the cap body; (d) a first ear position positioned in the cap body comprising a second mesh structure; (e) a second ear position positioned in the cap body comprising a third mesh structure; (f) a nasal ventilation positioned in the cap body comprising a fourth mesh structure; (g) a mouth ventilation positioned in the cap body comprising the fourth mesh structure or a fifth mesh structure; (h) a neck retainer base positioned on the neck retainer that is integrally formed with the neck retainer and comprises a sixth mesh structure or a two-layered structure; and (i) an edging at least partially surrounding the eye opening that comprises a three-layered structure.

20 Claims, 2 Drawing Sheets

(56) References Cited

U.S. PATENT DOCUMENTS

| | | | | | |
|---|---|---|---|---|---|
| 5,544,367 | A * | 8/1996 | March, II | A42B 3/00 | 2/410 |
| 5,845,340 | A * | 12/1998 | Frislie | A41D 13/1153 | 2/202 |
| 6,138,482 | A * | 10/2000 | Shima | D04B 1/106 | 66/172 R |
| 6,269,489 | B1 * | 8/2001 | Heath | A42B 1/046 | 2/171.4 |
| D751,768 | S * | 3/2016 | Kim | D29/108 | |
| 2006/0085881 | A1 * | 4/2006 | Gellis | A41D 13/1153 | 2/9 |
| 2015/0113711 | A1 * | 4/2015 | Kim | A42B 1/046 | 2/424 |
| 2016/0165992 | A1 * | 6/2016 | Brandt | A42B 1/008 | 2/171.2 |
| 2019/0014853 | A1 * | 1/2019 | Ji | A42C 5/04 | |
| 2019/0029350 | A1 * | 1/2019 | Brandt | A42B 1/008 | |

* cited by examiner

HELMET-SPECIFIC INNER CAP

RELATED APPLICATIONS

This application claims the foreign priority benefit of Chinese Patent Application Serial No. 201710574650.0, filed on Jul. 14, 2017, the entire disclosure of which is incorporated herein by reference.

BACKGROUND

1. Field of the Invention

The present invention generally relates to caps and headwear. More particularly, the present invention generally relates to cap liners for various helmets.

2. Description of the Related Art

Helmets are required for various sporting activities, including activities in both warm and cold environments. Unfortunately, helmets generally exhibit poor thermal properties and, therefore, do not greatly enhance the wearer's comfort in cold environments.

Recently, SKULLY cap liners have been increasingly worn by athletes under helmets when participating in sporting activities in colder environments. Such SKULLY cap liners are typically made from polyester and help wick away moisture from the wearer's head and provide a non-slip surface for the helmet. Consequently, SKULLY cap liners allow the helmets to better stay on due to the non-slip surface and also provide more comfort for the wearer.

However, SKULLY cap liners exhibit a number of deficiencies. First, SKULLY cap liners are typically only made of polyester; thus, there are limited materials that can be used to produce such cap liners. In addition, SKULLY cap liners are woven articles and, therefore, typically have a large number of seams due to the sewing of the woven fabric. Consequently, the large number of seams can cause discomfort to a wearer. Furthermore, due to the simplicity of material used to produce the SKULLY cap liners, the cap liners have limited features specially adapted for cold weather. Therefore, SKULLY cap liners do not optimize the warmth of a wearer during cold weather.

SUMMARY

One or more embodiments of the present invention generally concern a cap liner for a helmet. Generally, the cap liner comprises: (a) a cap body, wherein the cap body comprises an upper end portion comprising a first mesh structure; (b) a neck retainer, wherein the cap body and the neck retainer are integrally connected; (c) an eye opening positioned in the cap body; (d) a first ear position positioned in the cap body, wherein the first ear position comprises a second mesh structure; (e) a second ear position positioned in the cap body, wherein the second ear position comprises a third mesh structure; (f) a nasal ventilation positioned in the cap body, wherein the nasal ventilation comprises a fourth mesh structure; and (g) a mouth ventilation positioned in the cap body, wherein the mouth ventilation comprises the fourth mesh structure or a fifth mesh structure.

One or more embodiments of the present invention generally concern a cap liner for a helmet. Generally, the cap liner comprises: (a) a cap body, wherein the cap body comprises an upper end portion comprising a first mesh structure; (b) a neck retainer, wherein the cap body and the neck retainer are integrally connected; (c) an eye opening positioned in the cap body; (d) a first ear position positioned in the cap body, wherein the first ear position comprises a second mesh structure; (e) a second ear position positioned in the cap body, wherein the second ear position comprises a third mesh structure; (f) a nasal ventilation positioned in the cap body, wherein the nasal ventilation comprises a fourth mesh structure; (g) a mouth ventilation positioned in the cap body, wherein the mouth ventilation comprises the fourth mesh structure or a fifth mesh structure; (h) a neck retainer base positioned on the neck retainer, wherein the neck retainer base is integrally formed with the neck retainer and comprises a sixth mesh structure or a two-layered structure; and (i) an edging at least partially surrounding the eye opening, wherein the edging comprises a three-layered structure.

One or more embodiments of the present invention generally concern a method for producing a cap liner for a helmet. The method generally comprises knitting a thread to form the cap liner, wherein the cap liner comprises: (a) a cap body, wherein the cap body comprises an upper end portion comprising a first mesh structure; (b) a neck retainer, wherein the cap body and the neck retainer are integrally connected; (c) an eye opening positioned in the cap body; (d) a first ear position positioned in the cap body, wherein the first ear position comprises a second mesh structure; (e) a second ear position positioned in the cap body, wherein the second ear position comprises a third mesh structure; (f) a nasal ventilation positioned in the cap body, wherein the nasal ventilation comprises a fourth mesh structure; and (g) a mouth ventilation positioned in the cap body, wherein the mouth ventilation comprises the fourth mesh structure or a fifth mesh structure.

BRIEF DESCRIPTION OF THE FIGURES

Embodiments of the present invention are described herein with reference to the following drawing figures, wherein.

DETAILED DESCRIPTION

The present invention generally relates to helmet and cap liners that address the deficiencies of prior art liners. As discussed herein, the liners of the present invention can include ergonomic helmet or cap liners that provide superior thermal insulation properties and may enhance the comfort of the wearers. In particular, the cap liners of the present invention comprise a cap body and a neck retainer that are integrally formed so as to produce a cap liner with minimal seams.

Figure 1:
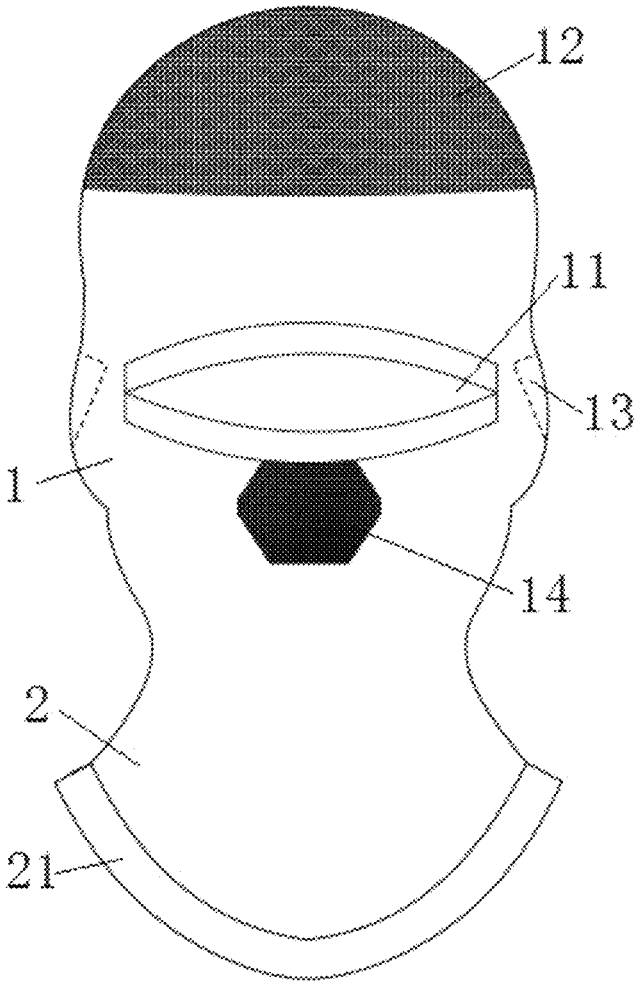
FIG. 1 depicts the cap liner according to one embodiment of the present invention.

For ease of reference, FIG. 1 depicts the general structure of the cap liner according to one or more embodiments of the present invention. It should be understood that the cap liner shown in FIG. 1 is just one example of a cap liner according to the present invention. Thus, the present invention may include other cap liner embodiments not specifically depicted in FIG. 1. The exemplary cap liner illustrated in FIG. 1 will now be described in detail.

As shown in FIG. 1, the cap liner generally comprises a cap body 1 and a neck retainer 2 that are integrally connected, or in other words, formed into a single woven article.

Furthermore, as shown in FIG. 1, the cap liner can also comprise an eye opening 11 at least partially surrounded by an edging formed from a mesh structure or a ribbed structure, an upper mesh structure 12 positioned at the top of the cap liner, ear positions 13 comprising mesh structures, a nasal/mouth region 14 comprising a mesh structure, and a neck retainer base 21 positioned on the neck retainer 2 that is integrally formed with the neck retainer 2 and comprises a mesh structure or ribbed structure. As depicted in FIG. 1, the nasal/mouth region 14 may be defined by a single mesh structure. Alternatively, and not depicted in FIG. 1, the nasal/mouth region 14 may also comprise two separate areas defined by two different mesh structures. As demonstrated in FIG. 1, the cap liner of the present invention is designed to fit under a helmet or cap to thereby provide enhanced thermal insulation to the wearer and to increase the comfort of the wearer, especially when the wearer is wearing a helmet.

In the present invention, the use of select knitting processes allow the production of a cap liner with a separate eye opening and several distinct mesh structures that are individually designed to enhance the comfort of the eyes, nose, and mouth of the wearer. In various embodiments, the knitting processes for producing the cap liners can comprise a weft knitting process. Furthermore, in various embodiments, the knitting processes used to produce the cap liner of the present invention can use a jacquard loom with 12 gauge needles and/or 14 gauge needles.

Additionally, the cap liners of the present invention may be produced from a variety of different materials. For example, the cap liners may be produce from polyester, wool, nylon, cotton, or combinations thereof. In certain embodiments, the cap liners can be produced from specialty polyester fabrics, such as COOLMAX from Invista. In one or more embodiments, the cap liners comprise, consist essentially of, or consist of polyester.

In various embodiments, the textile materials used to produce the cap liners can comprise a basis weight of at least 25, 50, 65, 70, 75, 80, 85, 90, 95, 100, 105, 110, 115, 120, 125, or 130 gsm. Additionally or alternatively, the textile materials used to produce the cap liners can comprise a basis weight of less than 400, 300, 250, 200, 190, 180, 170, 160, 150, 140, 135, 130, 125, 120, 115, or 110 gsm.

Generally, the cap body 1 of the cap liner can be knitted with an automatic top-up process. In various embodiments, the cap body 1 can have a helmet-type structure so that the cap liner may readily fit within an existing helmet. As noted above, the cap body 1 can be produced by a jacquard loom with 12 gauge needles and/or 14 gauge needles.

The neck retainer 2 can be produced with a curved or arc-shaped structure with a jacquard loom using 12 gauge needles and/or 14 gauge needles. This curved or arc-shaped structure of the neck retainer 2 may improve the comfort of the wearer by enhancing the fit of the cap liner on the wearer, in addition to improving the aesthetics of the cap liner.

As depicted in FIG. 1, the cap body 1 and the neck retainer 2 are integrally formed so as to form a single woven article. Thus, the cap body 1 and the neck retainer 2 may provide a more ergonomic fit for the wearer and thereby increase the comfort, aesthetics, and practicality of the cap liner. As used herein, "integrally formed" means that the identified sections are formed together in the absence of a plurality of seams.

The eye opening 11 of the cap liner is configured to be open and allow the wearer to see through the cap liner. In addition, in various embodiments, the eye opening 11 is at least partially surrounded by an edging in the form of a mesh structure or a ribbed structure. In certain embodiments, the edging at least partially surrounding the eye opening 11 can comprise an upper edge above the opening 11 and a lower edge below the opening 11.

Figure 2:
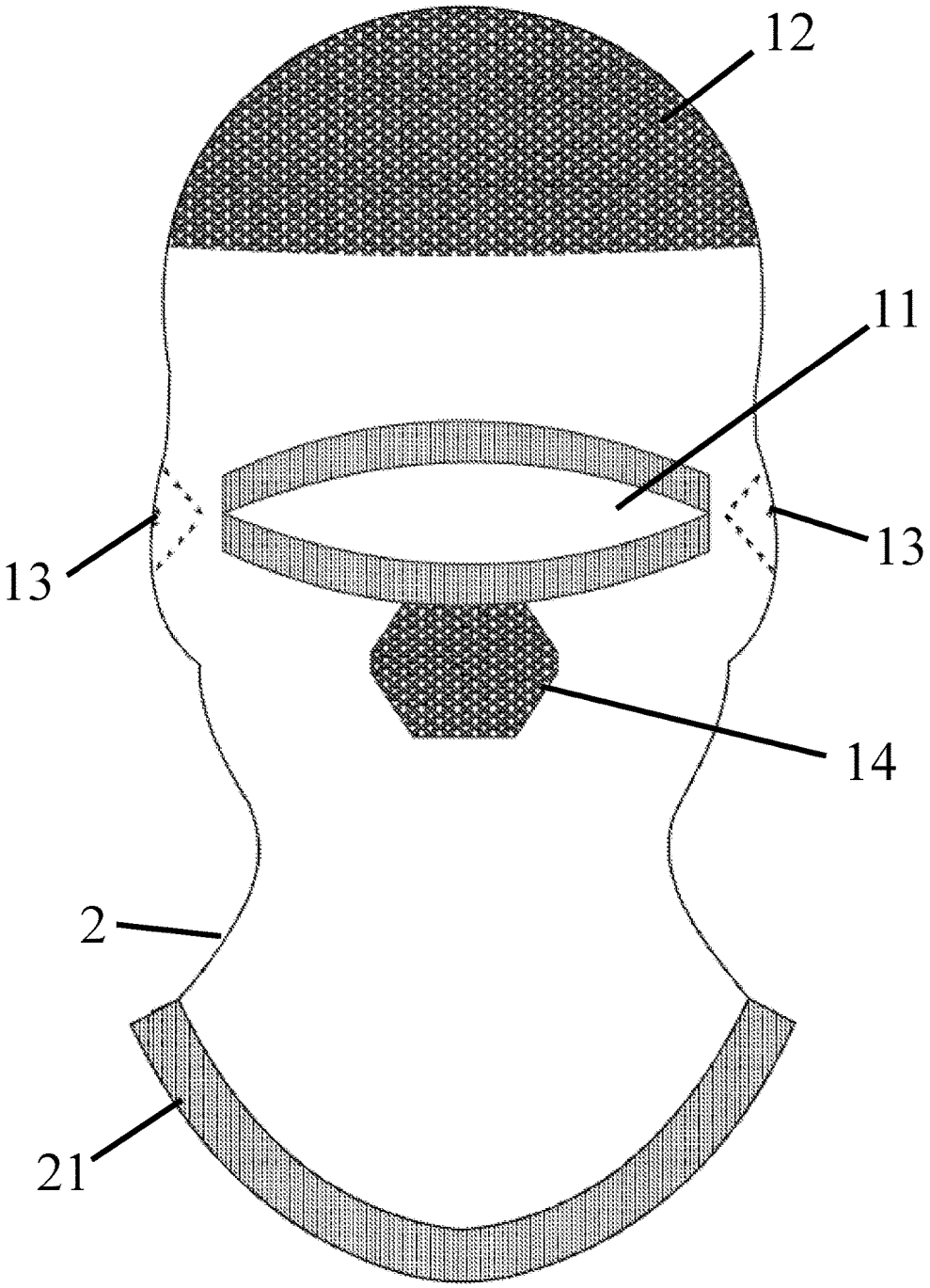
FIG. 2 depicts the cap liner according to one embodiment of the present invention, wherein the edging around the eye opening and the neck retainer comprise ribbed structures.

In various embodiments, and as depicted in FIG. 2, the eye opening 11 is at least partially surrounded by an edging defined by a ribbed structure such as a Full English Rib or a Half Milano Rib, which may be knitted by the above-referenced jacquard loom using an idling 1×1 needle method. Consequently, in various embodiments, the ribbed structure may be in the form of a multilayered structure, such as a two-layered structure (Full English Rib) or a three-layered structure (Half Milano Rib). In one or more embodiments, the eye opening 11 is at least partially surrounded by an edging formed by a three-layered structure, such as a Half Milano Rib, which can enhance the firmness, tension, and strength of the eye opening 11, so that the opening can be pulled down to the lower part of the nose or chin of the wearer.

The upper mesh structure 12 of the cap body 1 is designed to facilitate the transfer of heat from the wearer since the top of the head is usually the main heat dissipation area of the wearer. In other words, the upper mesh structure 12 can increase the breathability and ventilation properties of the cap liner and, therefore, enhance the comfort of the wearer. Generally, the upper mesh structure is designed to cover the wearer's scalp.

The ear positions 13 of the cap liner are generally positioned at the locations of the wearer's ears. Typically, the ear positions 13 can comprise identical or different mesh structures. The mesh structures of the ear positions 13 are generally designed to efficiently transmit sound from outside of the liner and the helmet to the wearer, while still providing warmth to the wearer's ears.

As discussed above, the nasal/mouth region 14 may comprise a single mesh structure as depicted in FIG. 1. Alternatively, the nasal/mouth region 14 may comprise a separate nasal ventilation area and a separate mouth ventilation area defined by separate mesh structures. Thus, in these alternative embodiments not depicted in FIG. 1, the nasal/mouth region can comprise a nasal ventilation area positioned in the cap body and a mouth ventilation area positioned in the cap body. The nasal/mouth region 14 is typically designed to efficiently allow the ventilation of air to the wearer and to also permit the wearer to clearly speak while wearing the cap liner.

As noted above in FIG. 1, the nasal/mouth region 14 of the cap liner can be defined by a single mesh structure in various embodiments. Thus, in such embodiments, the mesh structure of the nasal ventilation area and the mesh structure of the mouth ventilation area are formed from the same mesh structure. In other words, the nasal ventilation area and the mouth ventilation area are defined by a single mesh substrate in such embodiments.

Alternatively, in various embodiments, the nasal/mouth region 14 may comprise at least two separate and distinct mesh structures. Thus, in such embodiments, the mesh structure of the nasal ventilation area and the mesh structure of the mouth ventilation area are formed from different mesh structures.

In various embodiments, the ear positions 13 and/or the nasal/mouth region 14 may be at least partially coated with an elastic silicon gel to provide additional skid-proof regions on the cap liner.

In various embodiments, the neck retainer base 21 positioned on the bottom of the neck retainer 2 is integrally formed with the neck retainer 2. Furthermore, in various embodiments, the neck retainer 21 comprises a mesh structure or a ribbed structure. In certain embodiments, and as depicted in FIG. 2, the neck retainer 21 comprises a ribbed structure such as a Full English Rib or a Half Milano Rib, which may be knitted by the above-referenced jacquard loom using an idling 1×1 needle method. Consequently, in various embodiments, the ribbed structure may be in the form of a multilayered structure, such as a two-layered structure (Full English Rib). The use of the ribbed structure for the neck retainer base 21 can provide additional structure and strength to the base 21, which can allow the base 21 to effectively tighten around the neck of the wearer. Moreover, the use of the ribbed structure for the neck retainer base 21 can prevent the formation of valgus deformities and provide additional flexibility to the base 21, thereby permitting the cap liner to better stay on the wearer during windy conditions.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can be formed by a jacquard loom with 12 gauge needles and/or 14 gauge needles.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can be vertical, oblique, or staggered structures. When producing a mesh structure with a staggered structure, any of the mesh structures can be produced using a transfer method that involves the use of meshes having different sizes, such as small mesh sizes and large mesh sizes, which produce a "staggered" structure with meshes of different sizes. In one or more embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise different types of mesh structures. Alternatively, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise the same type of mesh structures.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise a stitch density of at least 1, 2, 3, 4, 5, 6, 7, 8, 9, or 10 stitches per cm and/or less than 150, 100, 50, 40, or 30 stitches per cm.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise an average loop length of at least 0.5, 1, 1.5, 2, 2.5, or 3 mm and/or less than 10, 9, 8, 7, 6, or 5 mm.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise a basis weight of at least 25, 50, 65, 70, 75, 80, 85, 90, 95, 100, 105, 110, 115, 120, 125, or 130 gsm. Additionally or alternatively, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can comprise a basis weight of less than 400, 300, 250, 200, 190, 180, 170, 160, 150, 140, 135, 130, 125, 120, 115, or 110 gsm.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can exhibit an air permeability of at least 400, 450, 500, 550, 600, 650, 700, 750, 800, 850, or 900 $ft^3$/min per $ft^2$ as measured according to ASTM D737-96.

In various embodiments, the mesh structure(s) at least partially surrounding the eye opening 11 (if present), the upper mesh structure 12, the mesh structures of the ear positions 13, the mesh structure(s) of the nasal/mouth region 14, and/or the mesh structure (if present) of the neck base 21 can exhibit a RET breathability rating of less than 13, 12, 11, 10, 9, 8, 7, 6, 5, 4, 3, 2, or 1 $R_{et}$ as measured according to ISO 11092.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second" element in the claims without departing from the scope of the present invention. Consistency is maintained within the description and each independent claim, but such nomenclature is not necessarily intended to be consistent therebetween.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A cap liner for a helmet, said cap liner comprising:

(a) a cap body, wherein the cap body comprises an integral body comprising an upper end portion comprising a first mesh structure;

(b) a neck retainer, wherein the cap body and the neck retainer are integrally connected;

(c) an eye opening positioned in the cap body;

(d) a first ear position positioned in the cap body, wherein the first ear position comprises a second mesh structure;

(e) a second ear position positioned in the cap body, wherein the second ear position comprises a third mesh structure;

(f) a nasal ventilation positioned in the cap body, wherein the nasal ventilation comprises a fourth mesh structure; and (g) a mouth ventilation positioned in the cap body, wherein the mouth ventilation comprises the fourth mesh structure or a fifth mesh structure.

2. The cap liner according to claim 1, further comprising a neck retainer base positioned on the neck retainer, wherein the neck retainer base is integrally formed with the neck retainer and comprises a ribbed structure.

3. The cap liner according to claim 2, further comprising an edging at least partially surrounding the eye opening, wherein the edging comprises a ribbed structure.

4. The cap liner according to claim 3, wherein the mouth ventilation comprises the fifth mesh structure.

5. The cap liner according to claim 1, wherein the first mesh structure, the second mesh structure, the third mesh structure, the fourth mesh structure, and the fifth mesh structure comprise vertical, oblique, or staggered structures.

6. The cap liner according to claim 1, wherein the cap body, the neck retainer, the first ear position, the second ear position, the nasal ventilation, and the mouth ventilation are produced from a polyester thread.

7. The cap liner according to claim 1, wherein the first mesh structure, the second mesh structure, the third mesh structure, the fourth mesh structure, and the fifth mesh structure comprise a basis weight of at least 25 gsm and exhibit an air permeability of at least 400 $ft^3$/min per $ft^2$ as measured according to ASTM D737-96.

8. A cap liner for a helmet, said cap liner comprising:

(a) a cap body, wherein the cap body comprises an integral body comprising an upper end portion comprising a first mesh structure;

(b) a neck retainer, wherein the cap body and the neck retainer are integrally connected;

(c) an eye opening positioned in the cap body;

(d) a first ear position positioned in the cap body, wherein the first ear position comprises a second mesh structure;

(e) a second ear position positioned in the cap body, wherein the second ear position comprises a third mesh structure;

(f) a nasal ventilation positioned in the cap body, wherein the nasal ventilation comprises a fourth mesh structure;

(g) a mouth ventilation positioned in the cap body, wherein the mouth ventilation comprises the fourth mesh structure or a fifth mesh structure;

(h) a neck retainer base positioned on the neck retainer, wherein the neck retainer base is integrally formed with the neck retainer and comprises a sixth mesh structure or a ribbed structure; and (i) an edging at least partially surrounding the eye opening, wherein the edging comprises a ribbed structure.

9. The cap liner according to claim 8, wherein the mouth ventilation comprises the fifth mesh structure.

10. The cap liner according to claim 8, wherein the first mesh structure, the second mesh structure, the third mesh structure, the fourth mesh structure, and the fifth mesh structure comprise vertical, oblique, or staggered structures.

11. The cap liner according to claim 8, wherein the cap body, the neck retainer, the first ear position, the second ear position, the nasal ventilation, the mouth ventilation, the neck retainer base, and the edging are produced from a polyester thread.

12. The cap liner according to claim 8, wherein the first mesh structure, the second mesh structure, the third mesh structure, the fourth mesh structure, and the fifth mesh structure comprise a basis weight of at least 25 gsm and exhibit an air permeability of at least 400 $ft^3$/min per $ft^2$ as measured according to ASTM D737-96.

13. The cap liner according to claim 8, wherein the neck retainer base comprises the ribbed structure.

14. A method for producing a cap liner for a helmet, the method comprising knitting a polyester thread to form the cap liner, wherein the cap liner comprises:

(a) a cap body, wherein the cap body comprises an integral body comprising an upper end portion comprising a first mesh structure;

(b) a neck retainer, wherein the cap body and the neck retainer are integrally connected;

(c) an eye opening positioned in the cap body;

(d) a first ear position positioned in the cap body, wherein the first ear position comprises a second mesh structure;

(e) a second ear position positioned in the cap body, wherein the second ear position comprises a third mesh structure;

(f) a nasal ventilation positioned in the cap body, wherein the nasal ventilation comprises a fourth mesh structure; and (g) a mouth ventilation positioned in the cap body, wherein the mouth ventilation comprises the fourth mesh structure or a fifth mesh structure.

15. The method according to claim 14, wherein the knitting comprises weft knitting.

16. The method according to claim 14, wherein the knitting is performed with a jacquard loom using 12 gauge needles and/or 14 gauge needles.

17. The method according to claim 14, wherein the cap liner further comprises a neck retainer base positioned on the neck retainer, wherein the neck retainer base is integrally formed with the neck retainer and comprises a ribbed structure.

18. The method according to claim 17, wherein the cap liner further comprises an edging at least partially surrounding the eye opening, wherein the edging comprises a ribbed structure.

19. The method according to claim 14, wherein the first mesh structure, the second mesh structure, the third mesh structure, the fourth mesh structure, and the fifth mesh structure comprise a basis weight of at least 25 gsm and exhibit an air permeability of at least 400 $ft^3$/min per $ft^2$ as measured according to ASTM D737-96.

20. The method according to claim 14, wherein the first mesh structure, the second mesh structure, the third mesh structure, the fourth mesh structure, and the fifth mesh structure comprise vertical, oblique, or staggered structures.

* * * * *